United States Patent [19]

Nichols et al.

[11] 4,089,624

[45] May 16, 1978

[54] CONTROLLED PUMPING SYSTEM

[75] Inventors: Philip Thorbus Nichols; Paul Jene Watts, both of Salt Lake City, Utah

[73] Assignee: Becton, Dickinson and Company, East Rutherford, N.J.

[21] Appl. No.: 692,897

[22] Filed: Jun. 4, 1976

[51] Int. Cl.[2] ..... F04B 35/04

[52] U.S. Cl. ..... 417/362; 74/89.15; 128/218 A; 417/419

[58] Field of Search ..... 417/419, 417, 415, 362; 74/22 A, 89.15, 424.8 R; 128/218 A, 218 P, 236, 214 F, DIG. 1

[56] References Cited

U.S. PATENT DOCUMENTS

| | | | |
|---|---|---|---|
| 996,128 | 6/1911 | Payne et al. | 128/218 A |
| 1,552,068 | 9/1925 | Lee | 417/362 |
| 1,751,139 | 3/1930 | Feinstein | 128/236 |
| 1,988,480 | 1/1935 | Campkin | 128/218 A |
| 2,543,100 | 2/1951 | Engh | 74/424.8 R |
| 2,606,454 | 8/1952 | Westling | 74/424.8 R |
| 3,335,724 | 8/1967 | Gienapp | 128/218 A |
| 3,623,474 | 11/1971 | Heilman | 128/218 A |
| 3,838,948 | 10/1974 | McCorvey | 417/419 |
| 3,880,138 | 4/1975 | Wooten et al. | 128/218 A |
| 3,943,717 | 3/1976 | Schexnayder | 92/86 |

*Primary Examiner*—C. J. Husar
*Attorney, Agent, or Firm*—Mario A. Martella

[57] ABSTRACT

A pumping system for dispensing controlled and variable amounts of fluids in predetermined quantities includes a pump piston which moves axially in a pump chamber. The piston is reciprocated by a drive lead nut cooperating with a non-rotatable lead screw attached to the piston. The piston is sealed to the pump chamber by a seal element whose distance from the lead nut is fixed regardless of the position of the piston, thus protecting the seal. The rotatably driven lead nut includes a hollow driven shaft, containing lubricant, so that the lead screw is lubricated as it travels into the shaft of the lead nut. The motor for the system is a pulse operated reversible stepping motor enabling accurate output from the pump, for example, between .01 ml/min to 9.99 ml/min as controlled by the stepping motor. One motor may drive two pumps for a continuous controlled pumping system. If desired a flush mechanism may be used to rinse the piston of any pumped material which adheres to the surface.

10 Claims, 7 Drawing Figures

FIG. 1
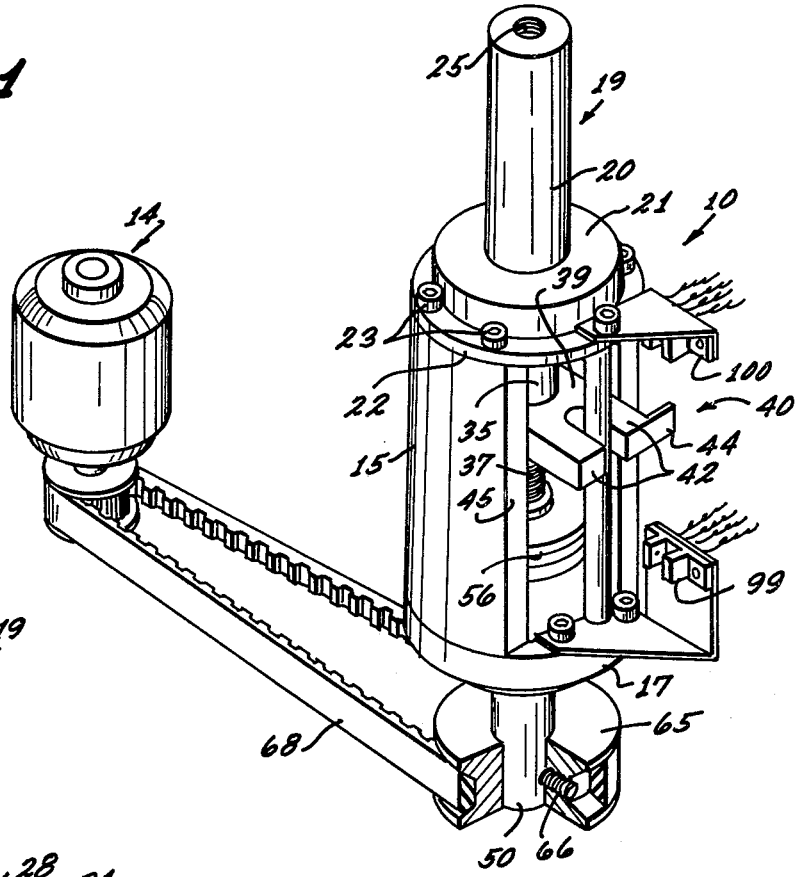
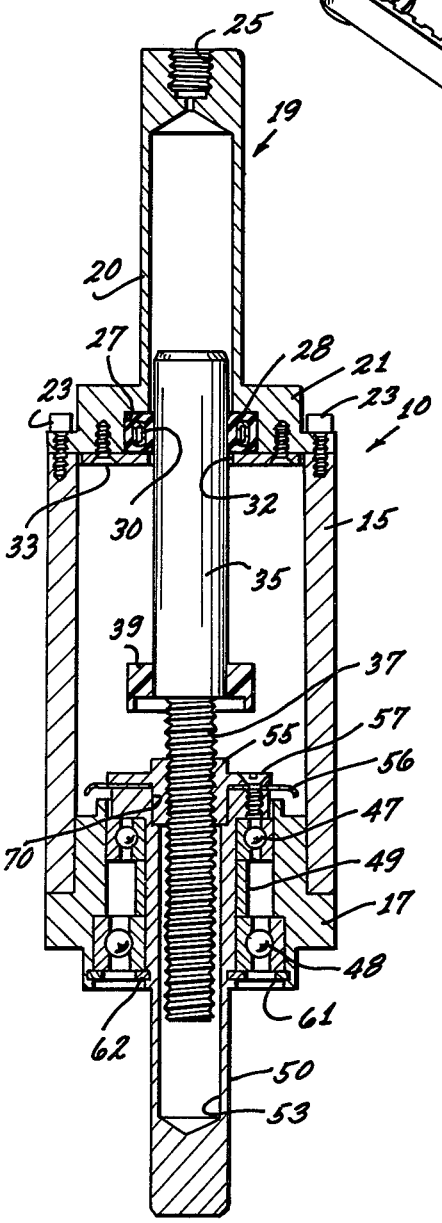
FIG. 2

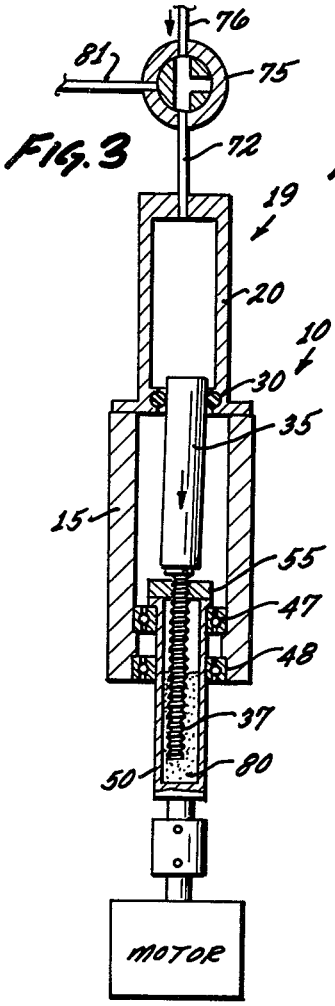
FIG. 3
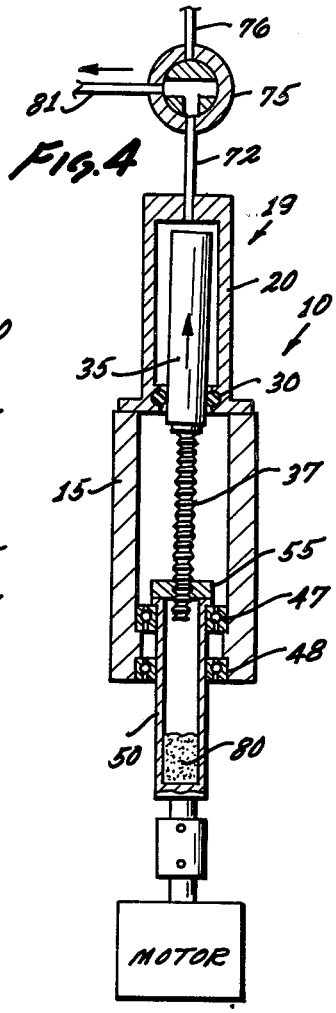
FIG. 4
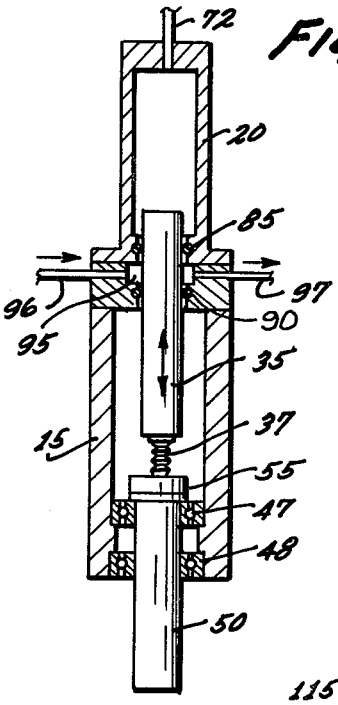
FIG. 5
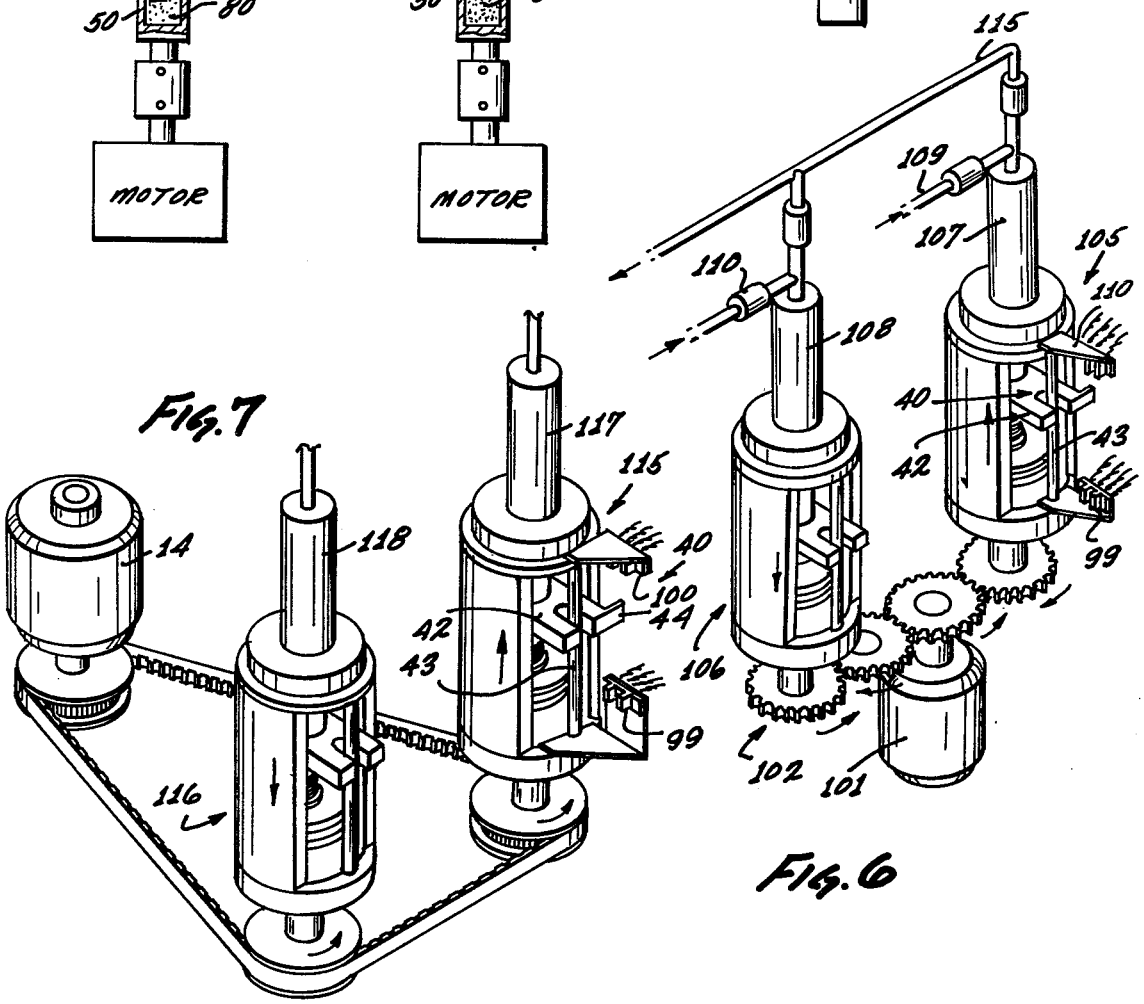
FIG. 7
FIG. 6

CONTROLLED PUMPING SYSTEM

BACKGROUND OF THE INVENTION

1. Field of the Invention

This invention relates to a new pump and pumping system and more particularly to an improved pump and pumping system for metering accurately controlled amounts of material to be pumped and wherein the amount of material pumped may be varied within known controlled amounts.

2. Background of the Invention

In chemical procedures qualitative or quantitative analysis or assays, it is frequently desirable to be able to pump reagents, in known amounts, by an automatic system. Typical such procedures include titration, radioimmunoassay procedures and the like.

In the medical field, it is sometimes necessary to pump fluids at known amounts, and often in variable quantities from one patient to another. For example in I.V. feeding of various liquids it may be necessary to control the rate from a fraction of a milliliter per minute to about 10 milliliters per minute or more. Other types of equipment also require pumps of known, controlled capacity, e.g., heart-lung machines, automatic blood assay equipment, and the like.

Many types of analytical equipment are now produced in which various reagents and samples are pumped at varying, but known, rates for the purpose of accurate analysis, for example, amino acid analysis, blood analysis equipment, and the like. One such automatic analysis system is the automatic radioimmunoassay equipment disclosed in United States Application Ser. No. 565,580, filed Apr. 7, 1975, and assigned to the same assignee. In this system, there are several pumps which operate in sequence to pump reagents and reactants at known rates, which rates may be variable depending on the type of assay.

DESCRIPTION OF THE PRIOR ART

It is known in the prior art to use motor driven syringe pumps which include a piston driven into a pump chamber at a controlled, but variable rate, by a driven rotatable lead screw. The piston is attached to a non-rotatable lead nut, which is driven by the rotation of the screw. Thus, the nut travels axially along the screw to effect reciprocating motion of the piston into the pump chamber, the latter including a seal assembly which surrounds the piston. It will be appreciated that the distance between the lead nut and the seal is variable depending upon the relative position of the nut on the lead screw.

If for some reason there is a slight misalignment between the center line of the piston and the center line of the pump chamber, leakage can occur. Under these circumstances, the seal element is presented with a continuously changing geometry and the seal element must conform to an opposed surface which is continuously changing its relative axial orientation. Effectively, the seal element must continuously flex as the piston moves. The overall result is high seal wear and leakage.

SUMMARY OF THE INVENTION

By the present invention, the difficulty of relatively short seal life and leakage in syringe type pumps is overcome. While the overall size of the pump is increased somewhat, the advantage of long seal life and leak free operation represents a substantial improvement.

Thus, in accordance with this invention, the improved pump is constructed such that a nut is rotatably driven rather than the screw, and the distance between the nut and the seal between the piston and the chamber remains the same regardless of the relative position of the piston. In effect the geometry between the seal and piston is maintained the same during piston movement. Even if there is a slight misalignment between the piston center line and the pump chamber center line, the geometry does not change since the distance between the axially fixed, driven lead nut and the seal is always the same.

Even if there is a small misalignment, the seal may move to an off-center position but does not thereafter continually change position as is the case with the prior art devices in which the lead screw is driven and the lead nut travels on the screw. Effectively, the piston is a floating piston with contact at the seal and the drive nut only.

By use of a pulse operated reversible stepping motor, the pump system of this invention may dispense as little as 0.5 microliters per pulse, or pump at a constant rate between 0.01 ml/min to 9.99 ml/min. Due to seal stability, pressures as high as 1000 psi may be generated without leaks.

Another feature of the pump of the present invention is that the lead screw may be easily and continuously lubricated since the lead nut, which is not reciprocated, includes a lubricant chamber into which the lead screw moves.

In another form, a pair of axially spaced seals is used in the pump chamber to form a rinse zone surrounding the piston. By circulating liquid through the rinse zone any material on the outer piston surface is removed, for example, deposits from the material being pumped. In this way build-up on the outer surface of the piston, which may score or damage the seals, is avoided.

The present invention also contemplates a continuous pump system using two pump units arranged to provide a controlled output, variable as previously described.

Other advantages as well as various modifications of the pump structure and system of the present invention will be apparent to those skilled in the art from the following detailed description of the preferred forms of the present invention.

DETAILED DESCRIPTION OF THE DRAWINGS

FIG. 1 is a view in perspective of the pump system of the present invention;

FIG. 2 is a view partly in section and partly in elevation showing the details of a pump assembly constructed in accordance with the present invention;

FIG. 3 and 4 are diagrammatic representations of the various stages of operation of the pump system in accordance with the present invention;

FIG. 5 diagrammatically shows, partly in section and partly in elevation, a modified form of pump assembly in accordance with the present invention;

FIG. 6 shows a pump system in accordance with the present invention in which two pump assemblies are used to effect continuous pumping by use of a gear mechanism; and FIG. 7 shows a pump system in accordance with the present invention in which two pump assemblies, one with a right hand and one a left hand thread, are used to effect continuous pumping.

DETAILED DESCRIPTION OF THE PREFERRED FORM OF THE INVENTION

Referring to FIG. 1 of the drawings, a preferred form of the pump system of the present invention is illustrated and includes a pump assembly 10 and a cooperating motor assembly 14, the latter preferably a pulse operated reversible stepping motor of the type used in computer equipment.

As illustrated in FIGS. 1 and 2, the pump assembly includes a support housing 15 generally in the form of an annular sleeve, one end of which is mounted on a pump base 17. Spaced from the pump base 17 by the support housing 15 is a pump cylinder assembly 19 including a pump cylinder 20 which is cylindrical in its inner configuration. In the form shown, the base 21 of the pump cylinder assembly is generally circular in shape and includes a flange 22 which is secured to the upper end of the support housing 15 by bolts 23 as indicated.

The upper end of the pump cylinder 20 includes a threaded opening 25 which forms the inlet and outlet for the pump. The underside of the base 21 is counter bored as indicated at 27 to form a seal chamber 28. Positioned within the seal chamber is a balanced seal element 30, the latter held within the seal chamber by an apertured seal retaining plate 32 secured to the underside of the pump cylinder base 21 by screws 33 as shown.

Mounted for movement in a generally axial direction into and out of the pump cylinder 20 is a pump piston 35, the latter being smooth and cylindrical in shape to fit the seal element 30, and secured to a lead screw 37. Thus, the lead screw 37 and the piston 35 can be considered as a unitary structure. The outer surface of the pump piston 35 is always spaced from the surface of the cylinder 20 so that there is never contact between the two.

Mounted on the lower portion of the piston 35 is a stabilizer arm 39 which travels with the piston 35 and which includes a blinder assembly 40 for motor control, as will be explained. The stabilizer arm 39 is bifurcated, the arms 41 and 42 passing on each side of a guide rod 43 which is attached between the base 21 of the pump cylinder and the base 17 of the housing. For this reason, the support housing 15 includes an opening 45 so that the guide rod 43 spans essentially the space between the seal retaining plate 32 and the pump base 17. Mounted on arm 42 is a blinder flag 44 which forms part of the blinder assembly.

Supported within the pump base 17 are a pair of spaced bearings 47 and 48, held in axial spaced relation by a bearing spacer 49. Positioned within the bearings is a rotatable drive shaft axle 50 which includes a hollow center section 53. The upper end of the drive shaft axle 50 includes a driven nut 55 mounted on the axle and rotatable with the drive shaft. Positioned between the nut in the upper end of the drive shaft axle is a drip deflector 56, the nut and drip deflector being fixed to the drive shaft axle by threaded screws 57 as indicated. The bearings 47 and 48 are retained in position by a retaining ring 61 which fits within slots in the pump base and a second retainer ring 62 which fits within a slot on the outer surface of the drive shaft axle, as illustrated.

Driving connection between the motor 14 and the drive shaft 50 may be by a timing belt pulley 65 which is locked to the shaft by a set screw 66 and driven by a notched timing belt 68 travelling between the motor and the pulley 65. It will also be apparent that the driving connection to the pump may be directly through the drive shaft axle 50.

As previously indicated, the drive shaft axle 50 is hollow and at its upper end is formed with a shoulder 70 which receives the nut 55, and thus the nut operates to close off the open end of the drive shaft axle. The interior 53 of the drive shaft axle may be partially filled with a lubricant for the purpose of lubricating the driven screw 37 each time it is advanced into and out of the hollow portion 53 of the drive shaft axle 50.

Referring to FIGS. 3 and 4, wherein like reference numerals have been used where applicable, the pump assembly of the present invention may be operated as a syringe type pump in which movement of the piston relative to the cylinder in one direction operates to fill the cylinder with liquid, and movement in the other direction operates to dispense from the cylinder a controlled amount of fluid at a controlled rate. Thus, the opening 25 is connected to a conduit 72 which in turn is connected to a multiport valve 75. In the position indicated in FIG. 3 the valve is connected to line 76 so that fluid may flow through line 76 through the valve, through line 72 to the cylinder 20 thus filling the same. To effect filling, the motor is rotated in a controlled manner to effect rotation of the drive shaft axle 50 and rotation of the drive nut 55, the drive shaft axle 50 being supported with the pump support housing and base by bearings 47 and 48. As the nut rotates, the lead screw 37 is moved axially, to effect movement of the piston, in the direction indicated by the arrow into the hollow drive shaft axle 50 which includes a lubricant 80.

To dispense fluid from the cylinder, the port of the valve 75 is oriented such that there is communication between line 72 and an outlet line 81 while the inlet line 76 is shut off, as shown in FIG. 4. The motor direction is then reversed causing the drive shaft 50 to reverse its direction. Since the nut 55 is attached to the drive shaft it too rotates causing the lead screw 37 to move in the direction indicated by the arrows thereby effecting controlled movement of the piston 35 into the cylinder 20 as illustrated in FIG. 4.

One of the advantages of the pump assembly of the present invention is the stability of wear life on the seal 30 which surrounds the piston. It will be observed that regardless of the relative position of the piston, the distance between the seal 30 and the nut 55 always remains essentially the same because the axial position of the nut is fixed. Thus, if there is some slight misalignment of the cylinder with the piston, shown in exaggerated proportion in FIGS. 3 and 4, seal member 30 need not continually readjust itself to a continually changing orientation of the piston with respect to the cylinder.

As illustrated, there is a slight eccentricity between the lead nut and the cylinder with the result that the compliant seal 30 must conform to the outer surface of the cylinder. Once the conformation is established, however, it remains the same regardless of the position of the piston within the cylinder simply because the distance between the seal 30 and the nut 55 remains the same throughout the reciprocating movement of the piston relative to the cylinder. In contrast to prior art devices, in which the piston is mounted on the drive nut rather than the lead screw, and in the presence of a slight misalignment, rotation of the lead screw results in axial movement of the nut and a change in geometry at the seal interface which is a continuing change in geometry.

It will also be noted that the piston is supported at one end by the drive nut, whose position is fixed axially and radially, and at the other end by seal 30, whose position is likewise fixed axially and radially relative to the nut. The piston is effectively a floating piston with contact at the seal and nut only. The result is that deviations in part dimensions or in assembly of parts within limits, does not result in seal damage.

It will be apparent that the piston is reciprocated in a nonrotating manner and is moved axially into and out of the cylinder. It is for this reason that a stabilizer arm 39 is mounted on the piston and travels along the guide rod 43 which prevents rotation of the piston during its reciprocating movement. It will also be apparent that for each cycle of the piston, the lead screw is lubricated by the lubricant within the hollow interior 53 of the drive shaft axle 50. The drip deflector 56 (shown in FIG. 2) functions to protect the bearing assembly.

The motor 14, as previously indicated, is a pulse operated reversible stepping motor of well known construction. For example, for each 200 pusles, the motor makes one complete revolution with a corresponding rotation of the nut as determined by the pulley or gear ratio. Thus, for each pulse applied to the motor, the pump dispenses 0.5 microliters of fluid assuming a chamber of 4.7 ml, a piston diameter of 0.5 inches and 16 threads-/inch on the lead screw. Since the motor is pulse operated, it is possible to vary the rate at which fluid is dispensed from the pump by varying pulse rate resulting in a pump capable of dispensing a variable average rate of fluid between 0.01 milliliters per minute to 9.99 milliliters per minute. Tests of the pump assembly constructed as illustrated indicate that the pump operates satisfactorily up to pressures of 1,000 psi without leakage, while providing the variable output as controlled by the stepping motor. It will be apparent that the number of threads per inch on the lead screw along with the piston diameter determines the piston displacement and thus the incremental amounts by which the output may be varied.

In the operation of the pump assembly described, the piston moves into and out of the cylinder and thus, the outer surface of the piston may be coated with a very thin film of material being pumped. To avoid corrosion of the seals and to avoid corrosion of the pump components, the major structural components are fabricated of a suitable corrosion resistant material such as stainless steel alloy. The seal element is preferably of polytetrafluoroethylene although it is understood that the seal composition may be selected to be compatible with certain liquids which are to be dispensed by the pump.

In a modified form of the pump in accordance with the present invention, as shown in FIG. 5, plural seal assemblies 85 and 90 are used and arranged in spaced relationship so as to form a rinse chamber 95 surrounding the piston 35, the chamber 95 communicating with an inlet line 96 and an outlet line 97. By introducing a flushing liquid, such as distilled water, into the rinse chamber 95 which surrounds the piston, it is possible to remove completely any residue which may remain on the outer surface of the piston. In this way, accumulation of salts or other materials on the outer surface of the piston is eliminated with the result that seal life is substantially increased by eliminating any possible scoring of the seal by residual solid deposits which may tend to build up on the outer surface of the piston.

In the arrangement of the pump assembly as shown in FIGS. 3, 4, and 5, the pump operates to dispense a variable controlled amount of fluid which is principally related to the volume of the piston. In order to protect the pump components, electrical sensors 99 and 100 (FIG. 1) may be used and mounted on the pump or separately therefrom so as the blinder flag 44 reaches sensor 100, the motor direction is automatically reversed or stopped, while sensor 99 likewise cooperates with the blinder flag to reverse or stop the direction of the motor as the piston is withdrawn from the cylinder. The sensors may be of a photoelectric type or a microswitch type, each well known in the art.

To effect continuous pumping at a controlled rate, variable within prescribed limits, an arrangement as illustrated in FIG. 6 may be used in which a single motor 101 operates through a gear train 102 to effect upward movement of the piston in pump 105 and simultaneous downward movement of the piston in pump 106. As noted, each of the pump chambers 107 and 108 includes an inlet 109 and 110, respectively, and a common outlet line 115. Lines 109 and 110 may be a common line, the respective lines being equipped with valves such as valve 75 or one-way check valves to permit the flow of fluid only in the direction indicated by the arrows. As previously described, the pump assembly includes the electronic sensor mechanism 99–100 which cooperates with the blinder assembly 40 carried by the stabilizer arm which travels on each of the guide rods 43. Thus, once the motor rate is set in accordance with the desired output rate of the system, the pump assembly illustrated in FIG. 6 will continue to dispense fluid from a reservoir at a controlled rate variable within the limits such as already described. The construction of the pumps 105 and 106 is essentially the same as that illustrated in FIGS. 1 and 2 with the exception that the respective drive shafts are driven off a common motor through a gear train 102 as illustrated, for example.

It is also possible in accordance with this invention to provide continuous pumping at a controlled rate by the system shown in FIG. 7. There, pump 115 may have a lead screw which is of left hand thread which pump 116 has a right hand thread on the lead screw. In all other essential respects the system of FIG. 7 is similar to that of FIG. 6. Here, a timing belt 68 and motor 14 are used to effect rotation in the direction indicated by the arrows. If desired each of pumps 105, 106, 115, and 116 may be of the flushing type illustrated in FIG. 5.

The use of stainless steel alloys for pump parts and inert self-lubricating seals is especially advantageous in pumps to be used for chemical analysis and in the medical field. Most advantageous, however, is the long life reliability of the seals and the leak-free operation where small amounts of fluids are being pumped. Moreover, the pump piston is supported at two spaced fixed points, the seal and the driven nut. The nut also functions to remove any excess lubricant to leave a thin coating on the lead screw.

In the flushing type pump of FIG. 5, the fact that the seals are spaced axially presents even greater problems if the prior art arrangement is used. By the present invention it is possible to hold the piston in fixed geometric relation to the seals since the nut is fixed axially and the piston is effectively supported between fixed spaced supports.

We claim:

1. A pumping system for dispensing controlled variable amounts of pumpable material comprising:

means forming a support housing, a pump cylinder assembly mounted on said housing and including pump cylinder means forming a pump chamber, said pump cylinder assembly including inlet and outlet means for the material being pumped, a pump piston and lead screw assembly mounted on said support housing for generally axial movement of the pump piston into and out of said pump chamber, driven nut means rotatably mounted in said support housing and receiving said lead screw, stationary seal means positioned at one end of said pump cylinder assembly and forming a fluid tight seal between said piston and pump cylinder means preventing leakage between said piston and pump chamber, said seal means being a distance from said drive nut which remains fixed during movement of said pump piston whereby the geometry between the seal means and said pump piston is maintained the same during movement of said pump piston relative to said seal means, said pump piston including an outer peripheral surface spaced from the opposing surface of said pump chamber and movable in sealing contact relative to said stationary seal means, means mounted on said pump piston and lead screw assembly to prevent rotation thereof, and motor means connected to effect rotation of said driven nut means whereby said pump piston is reciprocated relative to said pump cylinder assembly for pumping and filling said pump chamber.

2. A pumping system as set forth in claim 1 wherein said driven nut includes a hollow shaft, said pump cylinder assembly being spaced from said driven nut, said lead screw being moved in axial reciprocating manner into and out of said hollow shaft by said driven nut, and lubricant contained within said hollow shaft for lubricating said lead screw.

3. A pumping system as set forth in claim 1 further including valve means mounted for fluid communication with said inlet and outlet means for controlling flow of fluid into and out of said pump chamber.

4. A pumping system as set forth in claim 1 wherein said motor is a pulse operated reversible stepping motor.

5. A pump system as set forth in claim 1 wherein said seal means includes a pair of seals spaced axially, means forming a flushing chamber between said seals and surrounding said pump piston, and means to circulate flushing fluid into said flushing chamber.

6. A pump system as set forth in claim 1 wherein said pump piston is a floating piston supported by said drive nut and by said seal means.

7. A pump system as set forth in claim 4 including means to effect reversal of motor rotation as said piston reaches a predetermined position within said chamber.

8. A pump for dispensing controlled variable amounts of a pumpable material comprising:

a generally cylindrical pump housing having a pump base affixed at one end thereof and a cylinder assembly at the other end thereof, said cylinder assembly including a pump chamber and means forming an inlet and an outlet for said chamber, rotatable and axially fixed drive shaft means positioned within said pump base and including one end extending out of said pump base, bearing means mounted in said pump base to support said drive shaft in rotating relation relative to said housing, axially fixed drive nut means mounted on said drive shaft for rotation therewith, lead screw means mounted for axial movement by said drive nut, cylindrical pump piston means mounted for axial movement with said lead screw and movable axially into and out of said chamber to fill and discharge fluid therein, stationary seal means mounted in said cylinder assembly and in sealing relation with said piston to prevent leakage between said piston and said pump chamber, said piston being cylindrical and having an outer peripheral surface spaced from the opposing surface of said chamber and movable in sealing relation to said stationary seal means, said seal means being a distance from said drive nut which remains fixed during movement of said piston whereby the geometry between said seal means and said piston is maintained the same during movement of said piston relative to said seal means, and means to prevent rotation of said lead screw and said piston.

9. A pump as set forth in claim 8 wherein said drive shaft is hollow, said lead nut being mounted over the open end thereof, lubricant positioned within the hollow shaft and operative to lubricate said lead screw as the latter is driven into and out of said hollow shaft by said driven nut.

10. A pump as set forth in claim 8 wherein said seal means includes axially spaced seals each in sealing relation with said pump piston.

means forming a rinse chamber surrounding said piston and between said seals, and means to circulate rinsing fluid into and out of said rinse chamber to remove material on the center surface of said piston as the latter passes through said rinse chamber.

* * * * *